United States Patent [19]

Pipes

[11] 4,388,033

[45] Jun. 14, 1983

[54] SHUTTLE ASSEMBLY

[75] Inventor: George R. Pipes, Salt Lake City, Utah

[73] Assignee: Eaton Corporation, Cleveland, Ohio

[21] Appl. No.: 244,495

[22] Filed: Mar. 16, 1981

[51] Int. Cl.[3] ..... B66F 9/14

[52] U.S. Cl. ..... 414/282; 414/662; 52/118; 52/121; 212/269; 308/3 R

[58] Field of Search ..... 414/282, 662, 663; 212/269; 52/118, 121; 308/3 R

[56] References Cited

U.S. PATENT DOCUMENTS

| | | | |
|---|---|---|---|
| 3,283,924 | 11/1966 | Chasar | 414/282 |
| 3,556,329 | 1/1971 | Johnston | 414/663 |
| 3,934,741 | 1/1976 | Wentz | 414/663 |

FOREIGN PATENT DOCUMENTS

| | | | |
|---|---|---|---|
| 2335110 | 1/1974 | Fed. Rep. of Germany | 414/663 |

*Primary Examiner*—Richard A. Schacher

*Attorney, Agent, or Firm*—C. H. Grace; F. M. Sajovec

[57] ABSTRACT

A multiple-element load handling shuttle assembly (10) which includes means to compensate for the downward deflection of the load carrying element of the shuttle under load. Each shuttle element (12, 14, 16, 20) is supported by a plurality of rollers (35, 43, 51, 57) which engage guide channels (36, 43, 52, 58) in an adjacent element. The end rollers (**43*c*, 43*d*) on one of the elements are offset upwardly from the remaining rollers (43*a*, 43*b*) on that element and the corresponding guide channel (44**) is flared upwardly at its outer ends to accommodate the offset rollers. The offset rollers and flared guide channel cause the shuttle assembly to tilt upwardly in its unloaded condition to at least partially compensate for the downward deflection of the shuttle assembly under load.

6 Claims, 5 Drawing Figures

SHUTTLE ASSEMBLY

The present invention relates generally to shuttles for use on stackers and other material handling equipment, and more particularly to a shuttle of the type having multiple extending sections adapted for use in extremely deep storage bays.

Extended reach shuttles are generally known in the art relating to material handling equipment, as illustrated by U.S. Pat. No. 3,596,789. In a typical warehousing system in which such apparatus is used, a stacker vehicle is horizontally movable in an aisle between storage racks which define a plurality of storage bays on either side of the aisle. In order to remove articles from the storage bays and replace them therein, the stacker vehicle is equipped with a vertically movable load carriage having a laterally movable load support or shuttle assembly mounted thereon, the shuttle assembly including an end element which is extendable into a storage bay to either place a load therein or extract a load therefrom. In many cases the storage bays are extremely deep, requiring a shuttle assembly having multiple extending elements and able to extend several times its collapsed length to reach articles stored in such deep bays.

A persistent problem associated with the use of such extended reach shuttles is that of excessive deflection of the end load support or shuttle table when the shuttle is loaded and is at its full or nearly full extension. A possible solution to this problem is illustrated in U.S. Pat. No. 3,283,924, which discloses a shuttle assembly which includes curved guide means to cause the shuttle table to normally assume a slightly upwardly directed angle when it is extended to compensate for the sag or downward deflection of the shuttle table which will occur when the shuttle is loaded.

While the above solution is effective for a shuttle having a single movable element, the fabrication of curved guide members can be rather complex and expensive, and it would be difficult to incorporate a curved element in a shuttle having multiple movable elements. Accordingly, what the present invention is intended to accomplish is to provide a deflection compensating shuttle having multiple movable elements to provide extended reach, which is relatively simple to fabricate and which is thus inexpensive.

To meet the above objective, the present invention provides a shuttle assembly having multiple movable elements which includes offset guide rollers on one of the movable elements and a guide track on an adjacent element which is modified accordingly. More specifically, the end guide rollers on one of the shuttle elements are offset upwardly in relation to the inner rollers, and an upper wall of the roller guide track on an adjacent element is formed to define inclined planes which taper downwardly from the outer ends thereof, to define a roller guide track which is flared upwardly at either end by an amount substantially equal to the offset of the rollers. As a result of this construction, the shuttle assembly assumes a slightly upwardly tilted attitude from the modified elements outward when unloaded, which essentially compensates for the downward deflection of the assembly when it is loaded, the net effect being that the load can be maintained in nearly the desired horizontal attitude even at full extension of the shuttle.

Other advantages of the invention will become apparent from the following description when taken in connection with the accompanying drawings, wherein.

Figure 1:
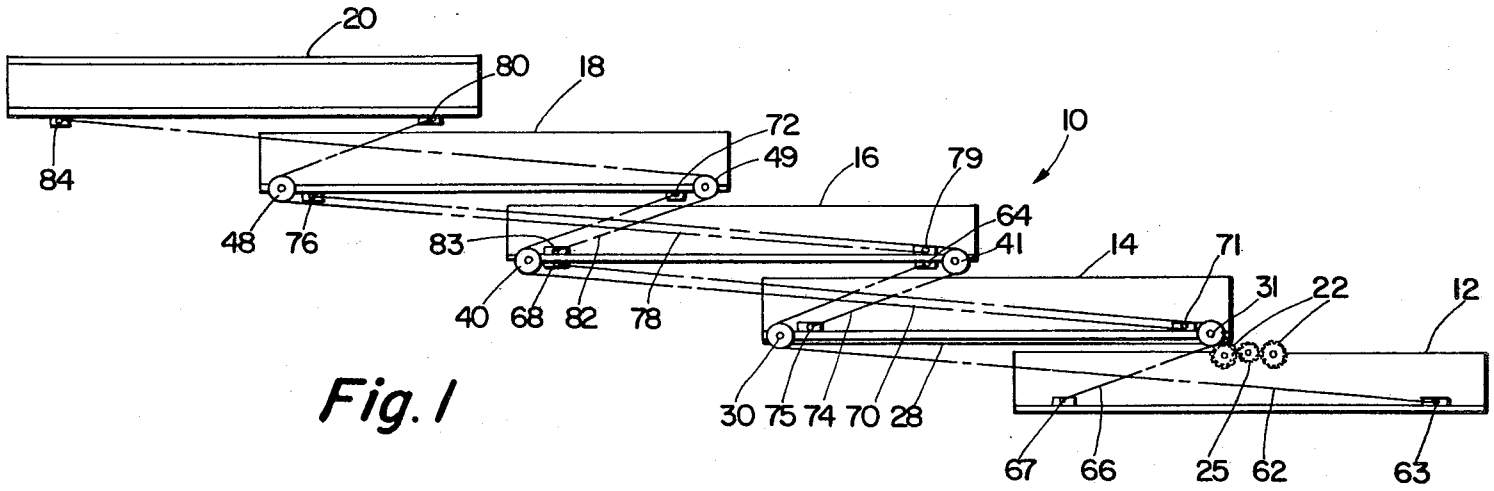
FIG. 1 is a schematic representation of a typical multiple-element shuttle assembly illustrating the means for extending and retracting the movable elements.
Figure 2:
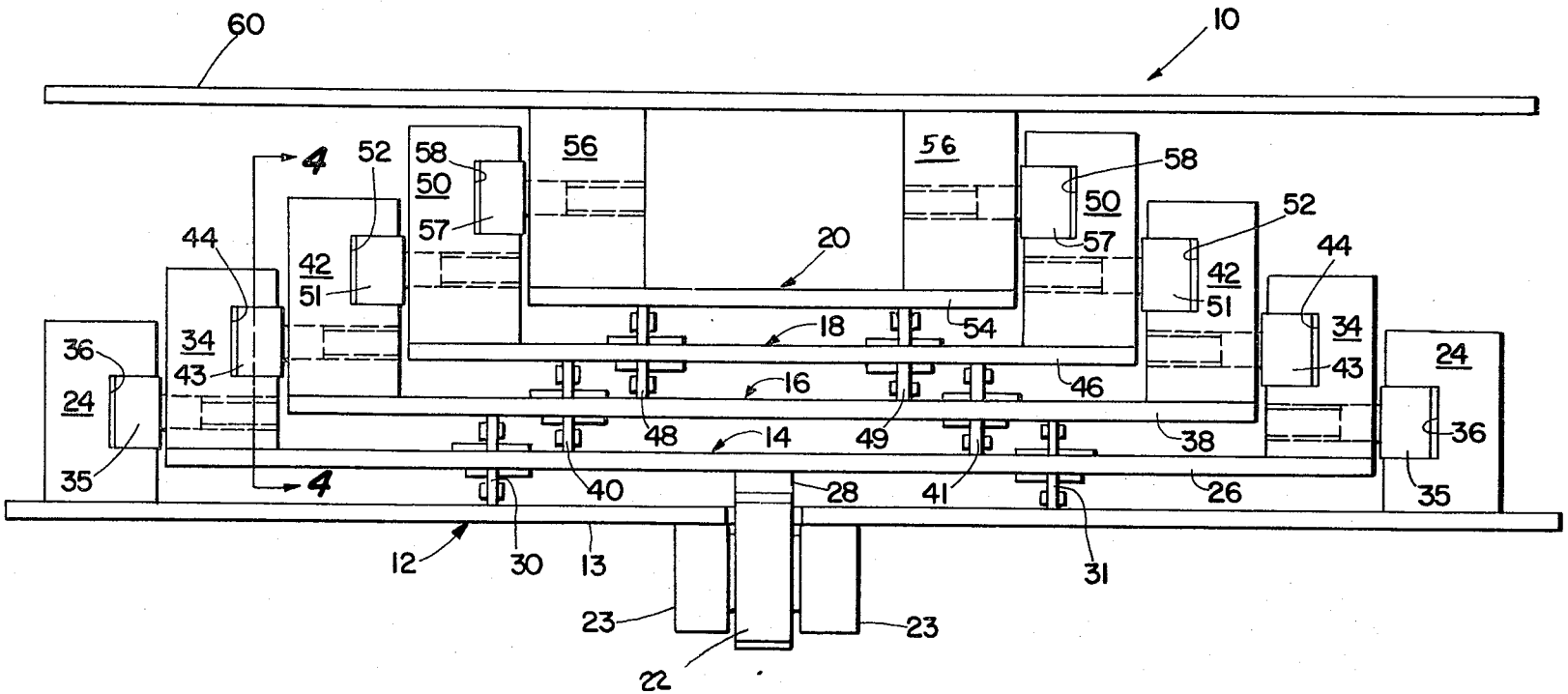
FIG. 2 is an end view of a typical shuttle assembly.

Referring to FIGS. 1 and 2, there is illustrated a schematic representation of a shuttle assembly 10 of the type used in connection with automated warehousing equipment to deposit material into a storage bay and extract it therefrom. The shuttle assembly comprises a stationary first shuttle element 12, a second shuttle element 14 movable relative to the first, a third shuttle element 16 movable relative to the second, a fourth shuttle element 18 movable relative to the third, and a fifth shuttle element 20 movable relative to the fourth. It will be appreciated that the five-element assembly is intended to illustrate an extended reach shuttle assembly, and that additional or fewer shuttle elements may be employed within the scope of the invention, the actual number of elements depending on the extent of reach required for a particular load handling application.

The stationary shuttle element 12 includes a base member 13, motor drive means (not shown) including a pair of output pinions 22 rotatably mounted on support members 23 attached to the base member 13 and geared together by means of an idler gear 25, and a pair of opposed track members 24 mounted on either side of the base. It should be noted that certain components such as track member 24 and its associated rollers, and additional related track members shown in FIG. 2 are omitted from FIG. 1 in the interest of clarity.

The second shuttle element 14 comprises a base member 26, an elongated rack member 28 attached to the underside of the base member and in meshing engagement with the output pinions 22, extend and retract sprocket assemblies received in slots formed in the base member 26 and including extend sprocket wheel 30 and retract sprocket wheel 31, a pair of elongated track members 34 attached to the top of the base member 26, and a plurality of rollers 35 rotatably attached to the track members 34 and received within channels or guide tracks 36 formed in the track members 24.

The third shuttle element 16 comprises a base member 38, extend and retract sprocket assemblies received in slots formed in the base member 38 and including extend sprocket wheel 40 and retract sprocket wheel 41, a pair of elongated track members 42 attached to the top of the base member 38, and a plurality of rollers 43 rotatably attached to the track members 42 and received within channels or guide tracks 44 formed in the track members 34.

The fourth shuttle element 18 comprises a base member 46, extend and retract sprocket assemblies received in slots formed in the base member 46 and including extend sprocket wheel 48 and retract sprocket wheel 49, a pair of elongated track members 50 attached to the top of the base member 46, and a plurality of rollers 51 rotatably attached to the track members 50 and received within channels or guide tracks 52 formed in the track members 42.

The fifth shuttle element 20 comprises a base member 54, a pair of elongated members 56 attached to the top of the base member 54, a plurality of rollers 57 rotatably attached to the members 56 and received within channels or guide tracks 58 formed in the track members 50, and a load platform 60 attached to the tops of members 56.

Referring to FIG. 1, a first chain 62 is attached to the stationary element 12, at 63, is reeved over sprocket wheel 30 on second shuttle element 14, and is attached to the third shuttle element 16 at 64. A second chain 66 is attached to the stationary element 12 at 67, is reeved over the sprocket wheel 31 on shuttle element 14, and is attached to the third shuttle element 16 at 68. A third chain 70 is attached to the shuttle assembly 14 at 71, is reeved over the sprocket wheel 40 on shuttle assembly 16 and is attached to the fourth shuttle assembly 18 at 72. A fourth chain 74 is attached to shuttle assembly 14 at 75, is reeved over the sprocket wheel 41 on shuttle assembly 14, and is attached to the shuttle assembly 18 at 76. A fifth chain 78 is attached to the third shuttle assembly 16 at 79, is reeved over the sprocket wheel 48 on shuttle assembly 18, and is attached to the fifth shuttle assembly 20 at 80. A sixth chain 82 is attached to third shuttle assembly 16 at 83, is reeved over the sprocket wheel 49 on shuttle assembly 18, and is attached to the fifth shuttle assembly 20 at 84.

The shuttle assembly 18 is shown in an extended position in FIG. 1. To retract the assembly, output pinions 22 are rotated clockwise, causing shuttle element 14 to move to the right due to the engagement of the pinions with the rack 28. As element 14 moves to the right, the portion of chain 66 between sprocket wheel 31 and element 16 is pulled to the right, causing element 16 to move to the right also. In like manner, the movement of element 16 to the right causes element 18 to move by means of chain 74 and sprocket wheel 41, and the movement of element 18 causes element 20 to move by means of chain 82 and sprocket wheel 49. The shuttle assembly 10 is etended in the same way by means of the chains 62, 70 and 78 and extend sprocket wheels 30, 40 and 48.

Figure 3:
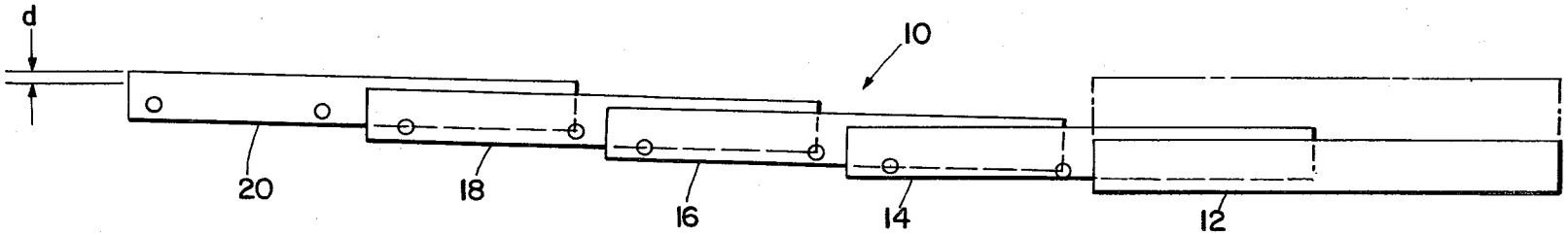
FIG. 3 is a schematic representation of a shuttle assembly constructed in accordance with the invention in an unloaded condition.

Referring to FIG. 3, the shuttle assembly 10 is shown in its extended position in an unloaded condition. It can be seen that the shuttle assembly is tilted upward from element 16 outward such that the end of the load receiving shuttle element 20 is displaced upward a distance "d" from the position it would be in were it not tilted. A closer inspection of FIG. 3 shows that this upward tilt occurs between shuttle elements 14 and 16.

Figure 4:
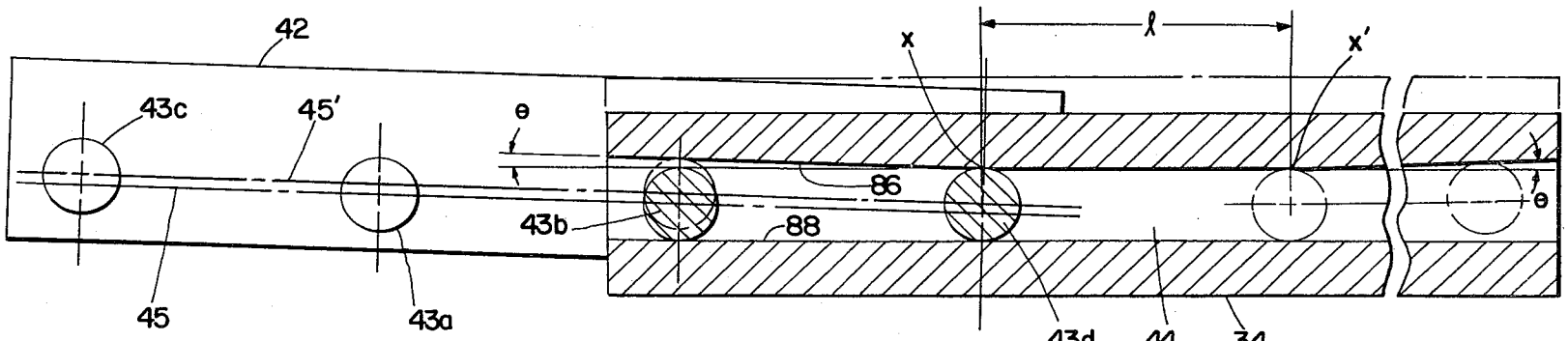
FIG. 4 is a sectional view taken along line 4—4 of FIG. 2.

In FIG. 4 there is illustrated, to a different scale from the other figures, one of the pair of tracks 34 of second shuttle element 14, and a corresponding track 42 of third shuttle element 16. Track 42 has four rollers 43 extending laterally therefrom, which are received in channel 44 formed in track member 34. The rotational axes of inner rollers **43*a* and 43*b* are located on a first line 45 parallel to the longitudinal axis of the track 42, while the rotational axes of the outer rollers 43*c* and 43*d* are located on a second line 45' parallel to the longitudinal axis of the track but offset upward slightly from line 45. Accordingly, referring to the full line position of FIG. 4, when shuttle element is extended relative to element 14, putting the tracks 34 and 42 in the relative position shown, the offset of the roller 43*d* relative to roller 43*b* will cause the track 42** and thus the shuttle element to which it is attached to assume the upwardly tilted attitude shown.

In order to accommodate both offset rollers **43*c* and 43*d* when the track 42 is moved between its retracted and extended positions relative to track 34, with the retracted position shown in broken line in FIG. 4, the upper wall 86 of channel 44, which defines an upper guide rail for the rollers 43, is slanted upward at both outer ends by an angle $\theta$ so that the channel 44 is flared upwardly at the ends thereof such that it is wider adjacent the ends by an amount substantially equal to the offset of the rollers. This permits the rollers 43 to assume the broken line position of FIG. 4 wherein track 42 is parallel to track 34** when the tracks are in their retracted positions, and to shift from this position to the full line position when extended.

The upper wall 86 of channel 44 is disposed at the angle $\theta$ from both ends of the track 34 to points x and x' leaving an area at the center of the track for a distance "l" where the upper wall 86 is parallel to the lower wall 88. The distance "l" is determined by the spacing between the rollers to insure that when the track 42 is moving from its retracted to its extended position, the roller **43*d* will enter the parallel wall portion of channel 44 before roller 43*b* enters the portion of channel 44 where wall 86 slopes upward from wall 88**.

It can be appreciated that the above construction not only provides means for compensating for the deflection of the shuttle under load when it is extended, but also permits the shuttle assembly to retract very compactly so that it occupies no more space when retracted than would a conventional shuttle having a like number of movable elements.

Figure 5:
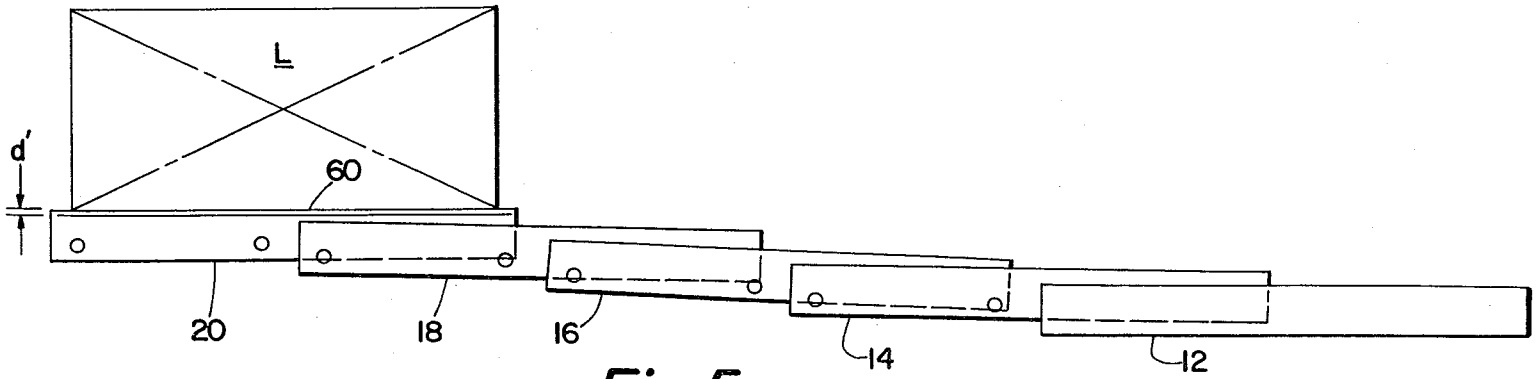
FIG. 5 is a schematic representation of the shuttle assembly of FIG. 3 in a loaded condition.

FIG. 5 shows the resultant position of the shuttle assembly when a load "L" is placed on the load platform 60, wherein the normal sag of the end shuttle elements under load takes up the initial upward offset caused by the displacement of element 16 relative to element 14, resulting in a slight downward deflection d', which is considerably less than the deflection which would occur were it not for the initial upward deflection provided by the invention.

I claim:

1. In a shuttle assembly operable between a retracted condition and an extended condition to move a load, comprising a stationary element; a plurality of stacked elongated elements movable relative to one another in a generally horizontal plane, said movable elements comprising one or more intermediate elements and a load engaging element; drive means interconnecting said stationary and movable elements and operable to move said movable elements telescopically to extend said load engaging element to a position remote from said stationary element; substantially straight guide channel means formed in said stationary and intermediate elements parallel to the direction of motion of said movable elements; first and second rollers mounted adjacent the ends of each of said intermediate and load engaging elements for rotation within the guide channel means of an adjacent element; and third and fourth intermediate rollers mounted on each of said intermediate and load engaging elements between said first and second rollers for rotation within the guide channel means of an adjacent element; the improvement wherein the first and second rollers of at least one of said movable elements are offset upwardly in relation to the remaining rollers on said element; and the guide channel means in which said offset rollers are received are flared upwardly adjacent the ends thereof.

2. Apparatus as claimed in claim 1 in which said ends of said guide channel means are flared upwardly to define a guide channel which is wider at its ends than at a central portion by an amount substantially equal to the offset of said first and second rollers.

3. Apparatus as claimed in claims 1 or 2, in which each of said stationary and movable elements comprises a base member and at least one elongated member attached thereto, said channel means being formed in a first side of said elongated member and defining upper and lower guide rails engageable by said rollers; and said rollers being mounted on a second side of said elongated member opposite said first side.

4. Apparatus as claimed in claim 3, in which said channel receiving said offset rollers is formed with portions of said upper guide rail sloped downwardly from the outer ends toward the central portion of said elongated member.

5. Apparatus as claimed in claim 4, in which the distance between said upper and lower guide rails at the central portion of said elongated member is a first dimension slightly larger than the diameter of said rollers, and the distance between the upper and lower guide rails at the ends of said elongated member is a second dimension larger than said first dimension substantially by the distance of the offset of said first and second rollers.

6. Apparatus as claimed in claim 5, in which said central portion of said elongated member extends for a distance at least equal to the distance between the rotation axis of either of said first or second rollers and the rotation axis of an adjacent third or fourth roller.

* * * * *